US006070413A

United States Patent [19]

Ward

[11] Patent Number: 6,070,413

[45] Date of Patent: Jun. 6, 2000

[54] CONDENSATION-FREE APPARATUS AND METHOD FOR TRANSFERRING LOW-TEMPERATURE FLUID

[75] Inventor: Britton N. Ward, Medway, Mass.

[73] Assignee: Temptronic Corporation, Newton, Mass.

[21] Appl. No.: 09/108,712

[22] Filed: Jul. 1, 1998

[51] Int. Cl.[7] ..... F17C 7/02

[52] U.S. Cl. ..... 62/50.7; 62/50.1; 138/114

[58] Field of Search ..... 62/50.7, 50.1, 62/51.2; 138/111, 113, 114

[56] References Cited

U.S. PATENT DOCUMENTS

| | | | |
|---|---|---|---|
| 3,777,502 | 12/1973 | Michie et al. | 62/50.7 |
| 4,014,369 | 3/1977 | Kobres | 138/112 |
| 4,715,187 | 12/1987 | Stearns | 62/50.7 |
| 4,878,354 | 11/1989 | Stearns et al. | 62/63 |
| 4,924,679 | 5/1990 | Brigham et al. | 62/50.7 |
| 5,291,741 | 3/1994 | Grimes | 62/51.3 |
| 5,307,639 | 5/1994 | Boissin | 62/50.7 |
| 5,400,602 | 3/1995 | Chang et al. | 62/50.7 |

FOREIGN PATENT DOCUMENTS

| | | | |
|---|---|---|---|
| 4135430 | 4/1993 | Germany | 62/50.7 |

*Primary Examiner*—William Doerrler

*Attorney, Agent, or Firm*—Samuels, Gauthier & Steven, LLP

[57] ABSTRACT

A system and method for transferring a low-temperature fluid includes a source of the low-temperature fluid coupled to a device being cooled by one or more fluid hoses or lines. The lines are surrounded by a cover which is coupled to a source of gas. The gas flows between the fluid lines and the cover such that the dew point of the atmosphere inside the cover is below the temperature of an outer surface of the hose such that condensation on the fluid lines is substantially eliminated.

36 Claims, 3 Drawing Sheets

CONDENSATION-FREE APPARATUS AND METHOD FOR TRANSFERRING LOW-TEMPERATURE FLUID

BACKGROUND OF THE INVENTION

There are many systems which require application of a low-temperature fluid at a location that is remote from the source of the fluid. In such systems, coolant hoses or lines are used to carry the fluid to the desired location. Typically, the fluid is circulated through the device being cooled. Hence, a pair of parallel coolant lines, an input line and an output line, are connected between the fluid source and the device being cooled.

For example, a semiconductor wafer prober machine used to electrically test semiconductor integrated circuits on a wafer can include the capability of temperature cycling a wafer under test. These machines typically include a wafer chuck used to hold the wafer in place while it is being tested. The chuck can include a heater and a heat sink for heating and cooling the wafer such that electrical circuit performance can be tested over temperature. The heat sink can include a fluid tube for circulating a low-temperature fluid near the wafer to cool the wafer. In this type of prober, the low-temperature fluid can be transferred from the fluid source to the prober machine. The coolant is then connected internally to the chuck. Such systems also include the capability of introducing a dry gas, such as air, nitrogen, or other gases, near the chuck to prevent condensation during low-temperature testing. A dry gas source can be provided inside the prober, or a separate gas dryer can be used.

Such systems typically operate in standard room ambient environments having typical room temperatures and humidities. As a result, when the low-temperature fluid flows through the coolant lines, condensation occurs and frost forms on the exterior surfaces of the lines. When the flow of fluid is interrupted, the frost melts, leaving pools of water on the floor.

SUMMARY OF THE INVENTION

The present invention is directed to a system and method for transferring a low-temperature fluid which overcomes the drawbacks of prior systems. The system includes a source of the low-temperature fluid and a hose for carrying the low-temperature fluid to the device being cooled, for example, a prober machine. The system also includes a source of gas to be transferred to the device being cooled. A cover is provided over the hose. A portion of the gas is transferred to the cover such that the gas flows between the hose and the cover. As a result of the gas flow, the dew point of the atmosphere inside the cover is lower than the temperature of the surface of the hose. Therefore condensation on the hose is substantially eliminated.

In one embodiment, the low-temperature fluid is circulated through the device being cooled. Therefore, the system includes at least two hoses within the cover between the source of the low-temperature fluid and the device being cooled. One of the hoses serves as a coolant input to the machine, and the other serves as an output or return to the source.

The system can include a separate stand-alone dry gas source which supplies dry, low-dew point gas, such as air, nitrogen, or other gas, to the device being cooled. As referred to throughout this application, a "dry" gas is a gas having a dew point that is sufficiently low to prevent condensation on surfaces within a particular environment of interest over expected temperatures of the surfaces. In this configuration, the dry gas is coupled to the device by a gas line. A second gas line is connected between the gas source and the cover to transfer a portion of the dry gas to the cover.

In another configuration, a gas drying device is included within the device being cooled. In this configuration, the device being cooled is provided with a gas output fitting. A gas line is connected between the gas output fitting and a fitting on the cover.

In another embodiment, a relatively wet gas from a separate source can be provided to the hose at a higher flow rate that the rate at which dry gas is provided. The high rate of gas flow provides convective heating to the hose carrying the fluid such that the temperature of the hose is raised above the dew point of the atmosphere inside the cover. Again, condensation and frost formation on the hose are eliminated.

The cover assembly includes a mounting clamp at one or both ends for connecting the cover to its respective interface, i.e., the device being cooled or the source of low-temperature fluid. In one embodiment, the gas is directed over the mounting clamp to substantially eliminate condensation and frost formation on the clamp. In one embodiment, this is accomplished by a plurality of holes through the cover assembly in proximity to the clamp. The gas on the inside of the cover passes through the holes and is directed onto the clamp.

The system and method of the invention provide numerous advantages over prior approaches to transferring low-temperature fluids. The approach of the invention virtually eliminates condensation on the coolant line assembly which transfers the cold fluid to the device being cooled. As a result, the frustrating and costly nuisance and hazard of pools of water being formed on the floor of the test area are eliminated.

BRIEF DESCRIPTION OF THE DRAWINGS

The foregoing and other objects, features, and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

Figure 1:
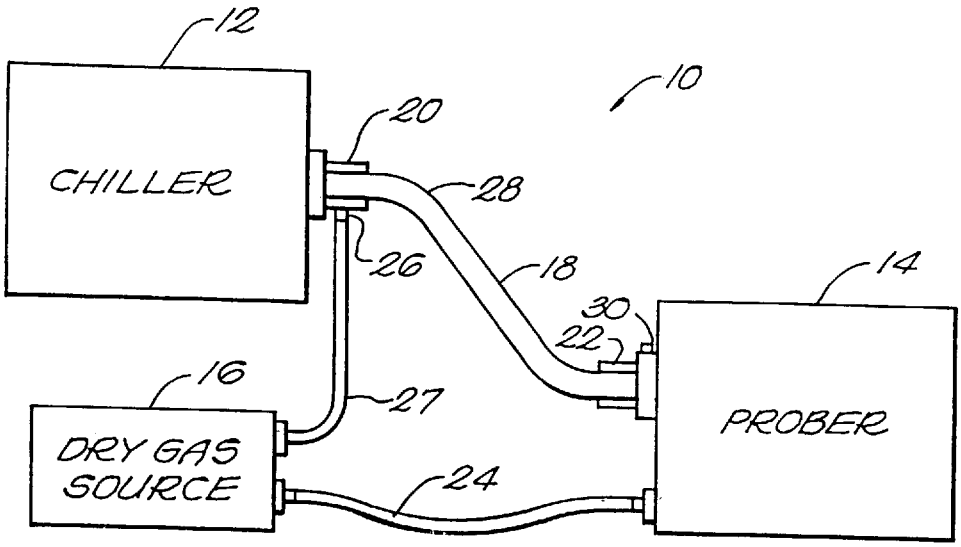
FIG. 1 is a schematic block diagram of one embodiment of a system for transferring a low-temperature fluid in accordance with the invention.

FIG. 1 is a schematic block diagram of a system 10 which transfers low-temperature fluid in accordance with the present invention. The system 10 includes a chiller unit 12 which generates the low-temperature fluid and circulates it to a device such as a circuit prober 14. The low-temperature fluid is transferred from the chiller 12 to the prober 14 via a coolant line assembly 18. The line assembly 18 is connected at its ends to the interface panels of the chiller 12 and prober 14 by end assemblies 20 and 22, respectively.

The system 10 also includes a dry gas source 16, such as a dry air or dry nitrogen source or a source of some other dry gas, which provides dry gas to the prober 14 via a gas line 24. In one embodiment, the source 16 provides air at a dew point of less than −60 degrees Celsius. The dry gas is introduced by the prober into the area near the wafer being tested to eliminate the effects of condensation and frost during low-temperature testing. In accordance with the invention, a portion of the dry gas produced by the source 16 is also transferred to the coolant line assembly 18 via a second gas line 27, which connects to the end assembly 20 at a gas fitting 26. The dry gas flows under a shroud or cover 28 which surrounds the coolant lines that carry the low-temperature fluid. The dry gas flowing between the cover 28 and the coolant lines provides a low-dew-point environment within the cover such that condensation and frost formation on the coolant lines when the low-temperature fluid flows through the coolant lines are eliminated.

It should be noted that the gas line 27 can be connected to either end assembly 20 or 22 of the coolant line assembly 18. Where the gas line 27 is to be connected to the end assembly 20 at the chiller 12, as shown in FIG. 1, the gas fitting 26 is formed on the end assembly 20. A cap 30 is placed over an opening in the end assembly 22. Where the gas line 27 is to be connected to end assembly 22, the gas fitting 26 is attached to end assembly 22, and the cap 30 is placed on end assembly 20.

Figure 2:
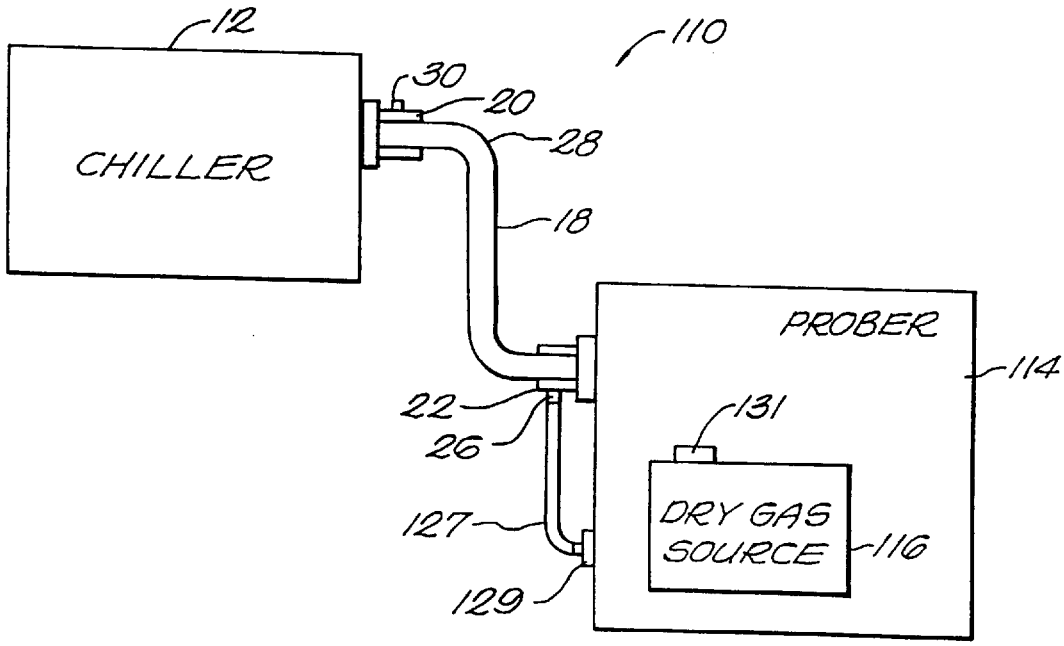
FIG. 2 is a schematic block diagram of an alternative embodiment of a system for transferring a low-temperature fluid in accordance with the invention.

FIG. 2 is schematic block diagram of an alternative embodiment of a system 110 in which low-temperature fluid is transferred from a chiller 12 to a device such as a circuit prober 114. In this embodiment, the prober 114 includes an internal dry gas source 116 which produces dry gas such as dry air, nitrogen, etc., for distribution within the prober through an outlet vent 131. An additional gas fitting connection 129 is provided on the panel of the prober 114 such that a portion of the dry gas within the prober body can be coupled by gas line 127 to the gas fitting 26 on the end assembly 22 of the coolant line assembly 18. In this embodiment, as in the previously described embodiment, the dry gas circulates within the coolant line assembly 18 under the outer cover 28 such that condensation and frost on the coolant tubes are eliminated.

Figure 3:
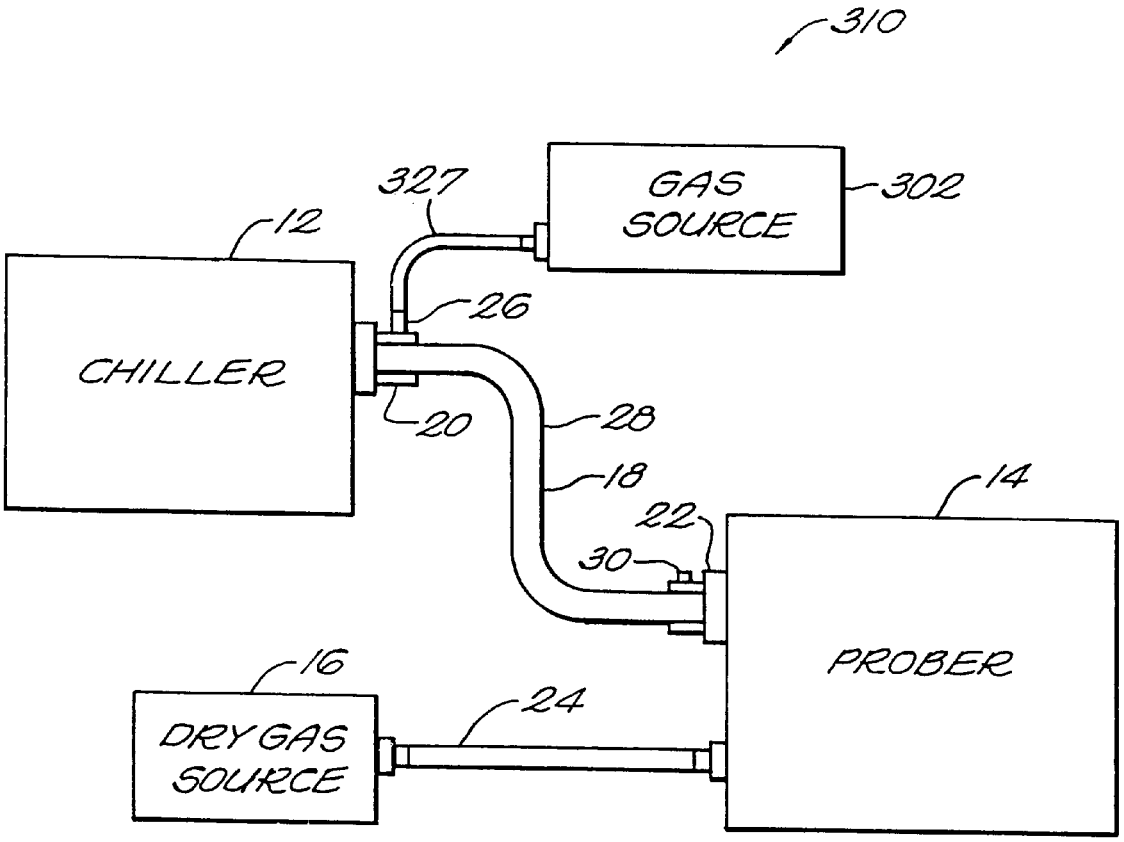
FIG. 3 is a schematic block diagram of another alternative embodiment of a system for transferring a low-temperature fluid in accordance with the invention.

FIG. 3 is a schematic block diagram of another alternative embodiment of a system 310 in which low-temperature fluid is transferred. In this embodiment, a separate gas source 302 is used to provide the gas that flows inside the cover 28 of the coolant line assembly 18. In this embodiment, the gas need not be a dry gas, such as the dry gas provided to the prober 14 by the dry gas source 16. Instead, the gas can have a comparatively higher dew point. In this case, the flow rate of the gas through the coolant line assembly 18 is greater than the rate of flow in the previously described embodiments. The gas flowing at a relatively high rate causes convective heating of the surfaces under the cover 28 such that condensation and frost formation are prevented.

Figure 4:
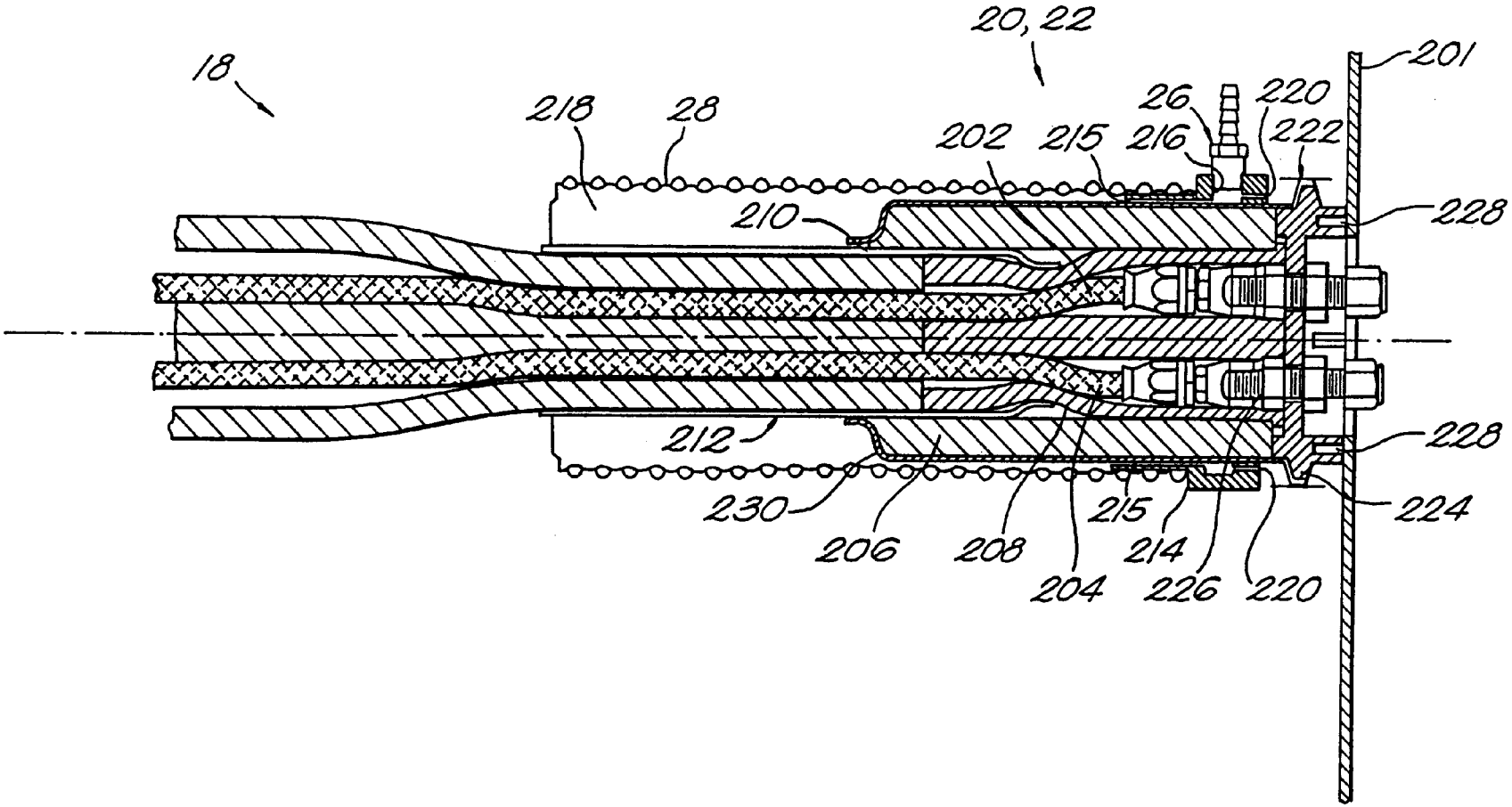
FIG. 4 is a schematic detailed cross-sectional diagram of one embodiment of an end assembly of a coolant line assembly in accordance with the present invention.

FIG. 4 is a schematic detailed partial cross-sectional view of an end assembly 20, 22 of one embodiment of a coolant line assembly 18 in accordance with the present invention. The end assembly 20, 22 is shown attached to the panel 201 of either the chiller unit 12 or the prober unit 14, 114. As shown, the assembly 18 includes a pair of fluid lines 202, 204 which carry the low-temperature fluid to and from the chiller 12 and/or prober. The coolant lines 202, 204 are connected to bulkhead flare fittings 226. Low-temperature fluid to and from the chiller unit passes through the fittings 226 into and out of the chiller and prober. The fluid lines 202, 204 are covered by thermal insulating materials which include an insulation tubing 206 and silicone tubing 208. A rigid support tube 210 surrounds the insulation tubing, and a heat shrink tube 212 surrounds the rigid support tube.

The flexible outer shroud or cover 28 is fixed to a rigid manifold 214. The cover or shroud 28 extends over the entire length of the coolant line assembly 18 up to the end assembly 20, 22 at the opposite end of the coolant line assembly line 18. A gas fitting 26 is located within an opening 216 in the manifold 214. Gas entering through the fitting 26 passes through multiple grooves or channels 215 formed in the manifold 214 and shown in the cross-section of FIG. 3. The gas is introduced into the space 218 inside the cover 28 via the gas fitting 26.

The end assembly 20, 22 attaches to the rear panel 201 at a thermal isolator 224 which is rigidly mounted to the panel 201 via screws or bolts 228. A mounting flange clamp unit 222 holds the outer support housing 230 of the end assembly 20, 22 to the thermal isolator 224. When cold fluid is passing through the fluid lines 202, 204, the temperature of the clamp 222 drops. This could tend to cause condensation and frosting on the clamp 222. To eliminate this, the manifold 214 includes multiple holes 220 which allow a relatively small portion of gas to exit the interior 218 of the cover 28 in proximity to the clamp 222. A small gap between the manifold 214 and the outer support housing 230 also allows gas to flow over the clamp 222. As a result, condensation and frosting on the clamp 222 are virtually eliminated.

While this invention has been particularly shown and described with references to preferred embodiments thereof, it will be understood by those skilled in the art that various changes in form and details may be made therein without departing from the spirit and scope of the invention as defined in the following claims.

What is claimed is:

1. A system for transferring a low-temperature fluid comprising:

a source of the low-temperature fluid;

a hose for carrying the low-temperature fluid from the source of the low-temperature fluid to a device to be cooled, the hose including a first end connected to the source of the low-temperature fluid and a second end connected to the device to be cooled;

a source of gas for generating gas to be coupled to the device to be cooled;

a cover over the hose extending from near the first end of the hose to near the second end of the hose, a first end of the cover being coupled to the source of low-temperature fluid and a second end of the cover being coupled to the device to be cooled; and means for transferring a portion of the gas from the source of gas to the cover over the hose, the gas flowing between the hose and the cover such that the dew point of the atmosphere inside the cover is below the temperature of an outer surface of the hose such that condensation on the hose is substantially eliminated.

2. The system of claim 1 further comprising a second hose inside the cover, the first and second hoses circulating the low-temperature fluid through the device to be cooled.

3. The system of claim 1 wherein the device to be cooled is a circuit prober machine.

4. The system of claim 1 wherein the source of gas is within the device to be cooled.

5. The system of claim 1 wherein the source of gas is separate from the device to be cooled.

6. The system of claim 1 wherein the cover includes a mounting clamp at an end of the cover.

7. The system of claim 6 wherein the cover comprises a plurality of holes in proximity to the mounting clamp such that gas within the cover flows over the mounting clamp to substantially eliminate condensation on the mounting clamp.

8. The system of claim 1 wherein the gas has a dew point below −60 degrees Celsius.

9. The system of claim 1 wherein the gas is dry nitrogen.

10. The system of claim 1 wherein the gas is dry air.

11. A method of transferring a low-temperature fluid comprising:

providing a hose for coupling a source of the low-temperature fluid to a device to be cooled to carry the low-temperature fluid from the source of the low-temperature fluid to the device to be cooled, the hose including a first end connected to the source of the low-temperature fluid and a second end connected to the device to be cooled;

providing a source of gas for generating gas to be coupled to the device to be cooled;

providing a cover over the hose extending from near the first end of the hose to near the second end of the hose, a first end of the cover being coupled to the source of low-temperature fluid and a second end of the cover being coupled to the device to be cooled; and transferring a portion of the gas from the source of gas to the cover over the hose, the gas flowing between the hose and the cover such that the dew point of the atmosphere inside the cover is below the temperature of an outer surface of the hose such that condensation on the hose is substantially eliminated.

12. The method of claim 11 further comprising providing a second hose inside the cover, the first and second hoses circulating the low-temperature fluid through the device to be cooled.

13. The method of claim 11 wherein the device to be cooled is a circuit prober machine.

14. The method of claim 11 wherein the source of gas is provided within the device to be cooled.

15. The method of claim 11 wherein the source of gas is separate from the device to be cooled.

16. The method of claim 11 further comprising providing a mounting clamp at an end of the cover.

17. The method of claim 16 further comprising forming a plurality of holes in the cover in proximity to the mounting clamp such that dry air within the cover flows over the mounting clamp to substantially eliminate condensation on the mounting clamp.

18. The method of claim 11 wherein the gas has a dew point below −60 degrees Celsius.

19. The method of claim 11 wherein the gas is dry nitrogen.

20. The method of claim 11 wherein the gas is dry air.

21. A system for transferring a low-temperature fluid comprising:

a source of the low-temperature fluid;

a hose for carrying the low-temperature fluid from the source to a device to be cooled;

a source of gas for generating gas to be coupled to the device to be cooled, said source of gas being within the device to be cooled;

a cover over the hose; and means for transferring a portion of the gas from the source of gas to the cover over the hose, the gas flowing between the hose and the cover such that the dew point of the atmosphere inside the cover is below the temperature of an outer surface of the hose such that condensation on the hose is substantially eliminated.

22. The system of claim 21 further comprising a second hose inside the cover, the first and second hoses circulating the low-temperature fluid through the device to be cooled.

23. The system of claim 21 wherein the device to be cooled is a circuit prober machine.

24. The system of claim 21 wherein the cover includes a mounting clamp at an end of the cover.

25. The system of claim 24 wherein the cover comprises a plurality of holes in proximity to the mounting clamp such that gas within the cover flows over the mounting clamp to substantially eliminate condensation on the mounting clamp.

26. The system of claim 21 wherein the gas has a dew point below −60 degrees Celsius.

27. The system of claim 21 wherein the gas is dry nitrogen.

28. The system of claim 21 wherein the gas is dry air.

29. A method of transferring a low-temperature fluid comprising:

providing a hose for coupling a source of the low-temperature fluid to a device to be cooled;

providing a source of gas for generating gas to be coupled to the device to be cooled, said source of gas being provided within the device to be cooled;

providing a cover over the hose; and transferring a portion of the gas from the source of gas to the cover over the hose, the gas flowing between the hose and the cover such that the dew point of the atmosphere inside the cover is below the temperature of an outer surface of the hose such that condensation on the hose is substantially eliminated.

30. The method of claim 29 further comprising providing a second hose inside the cover, the first and second hoses circulating the low-temperature fluid through the device to be cooled.

31. The method of claim 29 wherein the device to be cooled is a circuit prober machine.

32. The method of claim 29 further comprising providing a mounting clamp at an end of the cover.

33. The method of claim 32 further comprising forming a plurality of holes in the cover in proximity to the mounting clamp such that dry air within the cover flows over the mounting clamp to substantially eliminate condensation on the mounting clamp.

34. The method of claim 29 wherein the gas has a dew point below −60 degrees Celsius.

35. The method of claim 29 wherein the gas is dry nitrogen.

36. The method of claim 29 wherein the gas is dry air.

* * * * *